US007163112B2

(12) United States Patent
Lehnen et al.

(10) Patent No.: US 7,163,112 B2
(45) Date of Patent: Jan. 16, 2007

(54) MATERIAL TRANSLOADING EQUIPMENT

(75) Inventors: Bernd Lehnen, Memmingen (DE); Bernd Wager, Kirchdorf (DE)

(73) Assignee: Liebherr-Hydraulikbagger GmbH, Kirchdorf (DE)

( * ) Notice: Subject to any disclaimer, the term of this patent is extended or adjusted under 35 U.S.C. 154(b) by 0 days.

(21) Appl. No.: 10/347,011

(22) Filed: Jan. 17, 2003

(65) Prior Publication Data

US 2003/0234233 A1 Dec. 25, 2003

(30) Foreign Application Priority Data

Jan. 17, 2002 (DE) ..... 102 01 673

(51) Int. Cl.
*B66C 23/00* (2006.01)

(52) U.S. Cl. ..... 212/238; 52/116; 212/261

(58) Field of Classification Search ..... 212/238, 212/261; 52/116

See application file for complete search history.

(56) References Cited

U.S. PATENT DOCUMENTS

| | | | | | |
|---|---|---|---|---|---|
| 2,397,271 | A | * | 3/1946 | Ladwig | 212/287 |
| 2,675,209 | A | * | 4/1954 | Freed | 254/2 R |
| 2,759,616 | A | * | 8/1956 | Weyhausen | 414/732 |
| 3,279,621 | A | * | 10/1966 | Hackenberger | 212/238 |
| 3,385,014 | A | * | 5/1968 | Haug | 52/116 |
| 3,392,855 | A | * | 7/1968 | Przybylski | 414/694 |
| 3,465,904 | A | * | 9/1969 | Pensa | 414/694 |
| 3,571,956 | A | * | 3/1971 | Heiberg | 37/367 |
| 3,811,576 | A | * | 5/1974 | Fagen | 212/289 |
| 3,977,148 | A | * | 8/1976 | Ranini | 52/726.1 |
| 4,029,225 | A | * | 6/1977 | Wirt | 414/694 |
| 4,134,221 | A | * | 1/1979 | Scodeller | 37/395 |
| 4,235,567 | A | * | 11/1980 | Pilch | 414/694 |
| 4,616,454 | A | * | 10/1986 | Ballachey et al. | 52/115 |
| 4,892,201 | A | | 1/1990 | Hellwig et al. | |
| 5,011,364 | A | * | 4/1991 | Anderson | 414/694 |
| 5,048,172 | A | * | 9/1991 | Gravenhorst | 29/401.1 |
| 5,494,395 | A | * | 2/1996 | Raunisto | 414/694 |
| 5,538,149 | A | * | 7/1996 | Martin | 212/278 |

FOREIGN PATENT DOCUMENTS

| | | |
|---|---|---|
| DE | 3509364 | 10/1985 |
| DE | 199 09 356 | 9/2000 |
| EP | 0713839 | 5/1996 |
| GB | 2158041 | 11/1985 |

* cited by examiner

*Primary Examiner*—Thomas J. Brahan
(74) *Attorney, Agent, or Firm*—Dilworth & Barrese LLP

(57) ABSTRACT

The invention concerns a material transloading equipment unit with an undercarriage and a turntable connected with this undercarriage by means of a track ring, on which an arm that can be pivoted by means of at least one hoisting cylinder is pivot-mounted. According to the invention, on the one hand at least one additional pivot point for the arm is provided on the turntable and/or on the boom foot, and at least one additional pivot point is provided in the arm or in a pivot plate on the arm. This allows a number of possible combinations for the kinematics of the arm.

30 Claims, 3 Drawing Sheets

MATERIAL TRANSLOADING EQUIPMENT

BACKGROUND OF THE INVENTION

The invention concerns material transloading equipment according to the main concept of an under carriage and turntable connected therewith by a track ring on which an arm is pivot-mounted and pivotable in at least one hoisting cylinder.

A generic material transloading equipment unit is already known from DE 199 09 356 A1. This equipment has an undercarriage and an upper carriage, directly connected with this undercarriage by means of a track ring, which contains a power unit and a counterweight, as well as a working unit housed in a equipment trestle and a driver's cab connected with the equipment trestle. The equipment trestle with driver's cab can be positioned on the upper carriage by means of an intermediate structure or a spacing structure, in such manner that the working unit is positioned at a greater distance from the ground on the material transloading equipment unit.

In existing material transloading equipment, the kinematics of the boom is designed in such manner that the maximum possible load can be borne in the vicinity of the material transloading equipment unit. The problem that arises when the existing material transloading equipment is used for unloading ships, however, is that heavy loads must be borne over broad areas and under ground.

It is therefore the task of the invention to improve on the generic material transloading equipment in such manner that in addition to the customary industrial use an optimum-performance use in the loading and unloading of ships can alternatively be facilitated.

According to the invention, this task is performed by using the generic material transloading equipment in combination with the characteristic features set forth herein. Accordingly, at least one additional pivot point is provided on the turntable and/or on the boom foot, so that the boom pivot point can be changed as desired. Additionally, at least one additional pivot point is provided on the boom or in a pivot plate on the boom, so that the pivot point of at least one hoisting cylinder can be changed as desired. Better load values are thereby obtained, on the one hand over larger areas and depths in the customary industrial use, and on the other hand in transloading goods during, for example, the loading and unloading of ships. By appropriate choice of the pivot, the maximum moment of the cylinder can be shifted from a comparatively steep setting angle of the boom to a flatter setting angle of the boom. This leads to a reduction of high loads in the vicinity of the equipment and to an increase in loads with large ranges and under ground.

Preferred embodiments of the invention are also set forth herein.

Consequently, the pivot points can be in openings in the turntable, so that the boom can be swivel-mounted on the turntable by means of bolts passing through the openings. In this construction form of the invention, the boom can be adapted to the chosen use of the material transloading equipment simply by adjusting the bolts.

According to the invention, at least one hoisting cylinder is pivoted on the turntable on the one hand and on a pivot plate on the boom on the other hand, to raise and lower the boom. It is particularly advantageous to provide at least one additional pivot point on the pivot plate in addition to the customary pivot point, so that the pivot point of the hoisting cylinder can be changed at will. This also allows the setting angle of the boom at which the maximum moment is reached to be changed, while at the same time the overall pivot angle of the boom can remain constant.

A particularly advantageous development of the invention results from the fact that the first and second pivot points for the boom and the pivot point for at least one hoisting cylinder are positioned in a bearing block that can be connected with the turntable. According to the invention, modular bearing blocks of various lengths can be provided so that the position of the individual pivot points in relation to the turntable can be varied by the choice of a bearing block. The result is numerous possibilities of kinematic variation. The use of these bearing blocks is particularly advantageous for transloading in the loading or unloading of ships, since, for example, a higher pivot of the boom and hence a flatter angle position in relation to the wall of the ship is thereby achieved. Boom and shaft can thus be shorter and lighter. Appropriate enhanced bearing blocks can also advantageously be used for scrap shear loading.

BRIEF DESCRIPTION OF THE DRAWINGS

Additional details and advantages of the invention are explained in greater detail by means of an embodiment illustrated in the drawing and showing.

DESCRIPTION OF THE PREFERRED EMBODIMENTS

Figure 1:
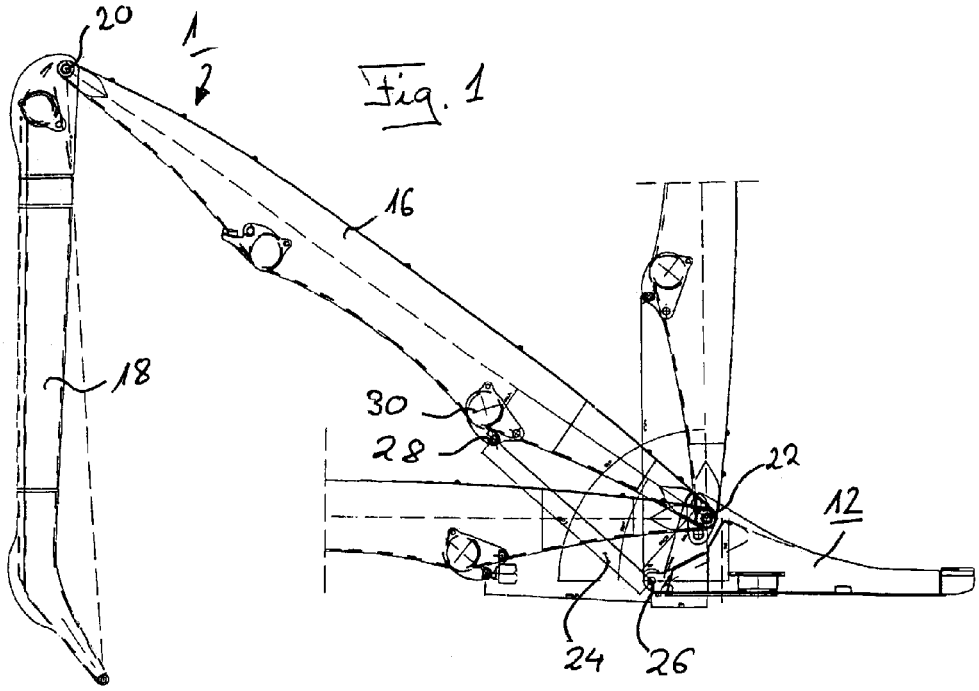
FIG. 1: A diagrammatic representation of a boom pivoted on a turntable in various positions according to a first embodiment of the within invention.

FIG. 1 shows a portion of a transloading equipment unit having a turntable 12 on which a boom 14 is pivoted. In the embodiment illustrated here, boom 14 is composed of two boom arms 16 and 18, which in turn are pivot-mounted together on a pivot point 20, in which the two arms can be pivoted in relation to each other by means of a hydraulic cylinder arrangement not shown here in detail. Boom arm 16 is pivot-mounted by means of a bolt in an opening 22 in the turntable 12. Boom arm 16 is raised and lowered by means of a hoisting cylinder 24 fitted on the one hand into a pivot point 26 in Turntable 12 and on the other hand into a pivot point 28 on a pivot plate 30 attached to boom arm 16. Only one hoisting cylinder 24 is shown here in FIG. 1. However, the variant embodiment represented here has two hoisting cylinders that run parallel to each other. FIG. 1 illustrates the customary industrial kinematics, in which the maximum moment of hoisting cylinder 24 is reached at a steep setting angle of the boom arm 16.

Figure 2:
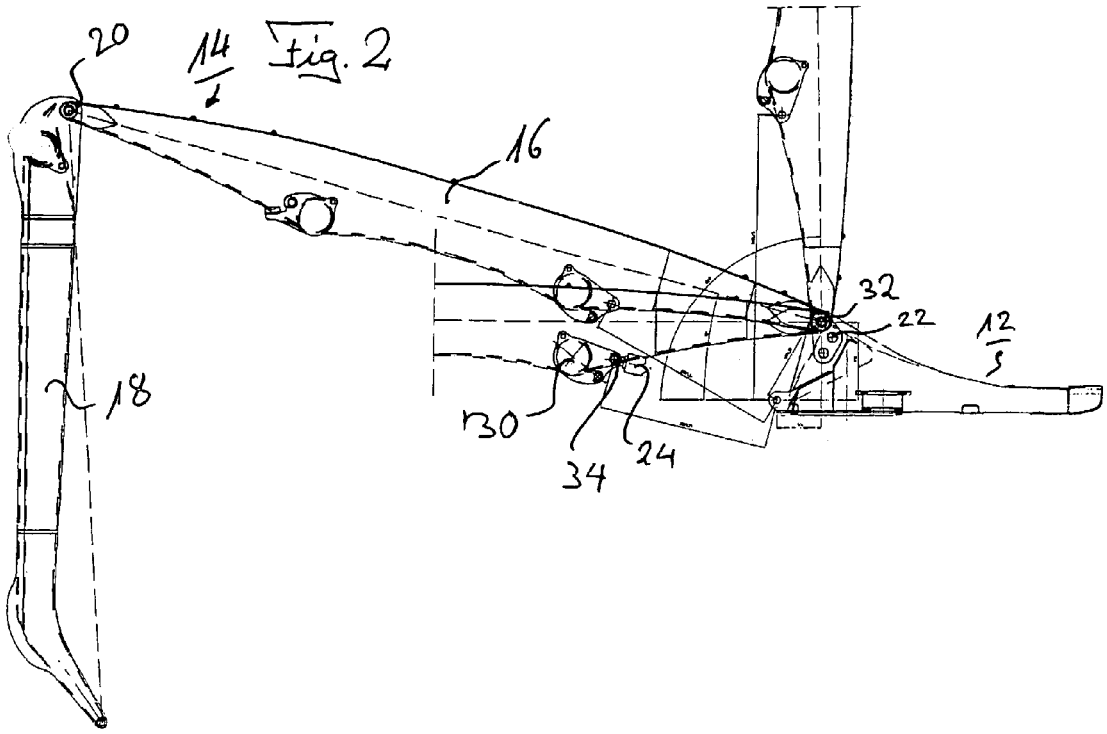
FIG. 2: A representation according to FIG. 1, in which the boom has a different kinematics.

In FIG. 2 the boom arm 16 is connected by means of its connection bolts with an opening 32 in turntable 12, this opening being positioned higher and further forward in relation to the rotation point of the turntable. This opening 32 of turntable 12 is hereinafter called the "ship opening," while opening 22 is hereinafter called the "industry opening." At the same time, in order to achieve the same kinematics, that is, the same starting and ending angle of boom arm 16, cylinder 24 is pivoted on an offset pivot point 34 positioned in pivot plate 30. With this kinematics, the maximum moment of the hoisting cylinder 24 is achieved with a relatively flat setting angle of the boom arm. This means that the material transloading equipment can bear high loads over comparably greater distances and even under ground.

Figure 3:
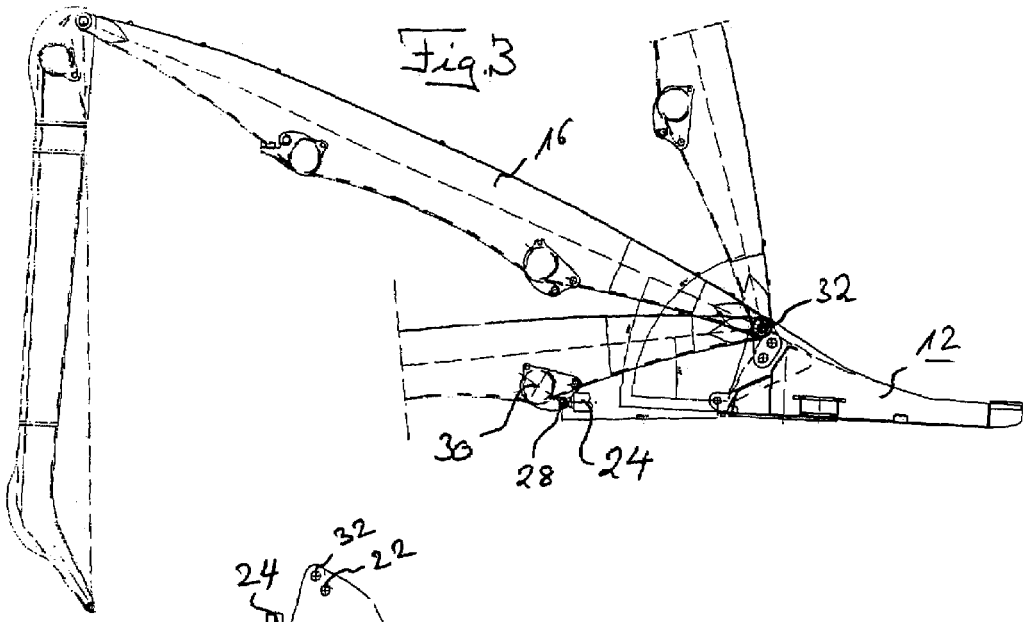
FIG. 3: A representation of the boom according to FIG. 1 or FIG. 2, in which the boom has yet another kinematics.

In FIG. 3 the boom arm 16 is similarly pivoted in ship opening 32 of the turntable 12. Here, however, hoisting cylinder 24 is pivoted via the same opening 28 to pivot plate 30, as was the case in the variant embodiment according to FIG. 1. The boom setting angle of maximum moment thus lies between the steep and flat setting angle of the previous kinematics, yet the result is a different overall pivot angle.

The maximum moment achievable with hoisting cylinder 24 is thereby achieved with a boom arm 16 setting angle of 22.7 degrees.

The optimum working range of the material transloading equipment can be varied by simply adjusting the bolts of boom 16 and hoisting cylinder(s) 24.

Figure 4A:
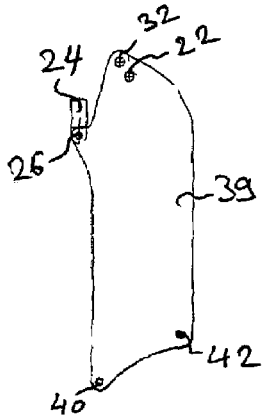
FIG. 4: A side view of an undercarriage of a material transloading equipment unit according to the invention, with turntable positioned on this undercarriage, and exploded components of the turntable.
Figure 4:
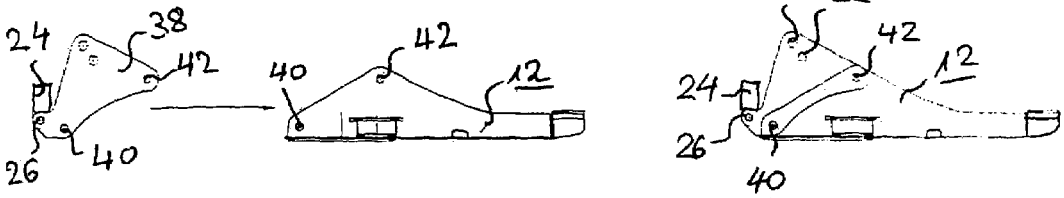
Figure 4:
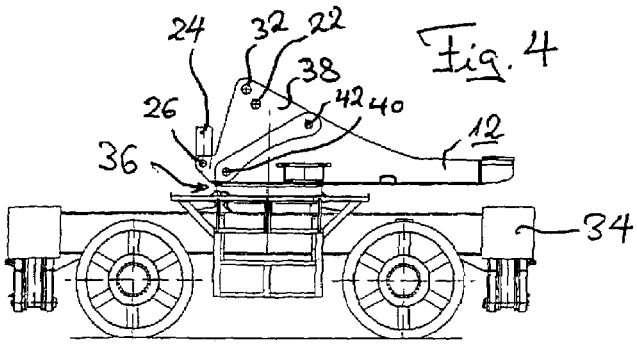

FIG. 4 shows the under-carriage 34 of the material transloading equipment unit. The turntable is shown via a track ring 36 on this equipment. In the variant embodiment illustrated here, turntable 12 is equipped with a separate bearing block 38 with openings 32 or 22 for the boom arms 16 (not shown here) and with opening 26 for hoisting cylinder(s) 24.

In the exploded view in FIG. 4*a*, turntable 12 is shown in combination with two bearing blocks 38 or 39 of different geometries. Bearing blocks 38 or 39 are connected with turntable 12 by means of separable connections. Bearing blocks 38 or 39 differ in height. The bearing blocks represented here are merely examples of configuration of a module that facilitates the positioning of pivot points 32, 22, or 26 in a desired position on turntable 12.

Figure 5:
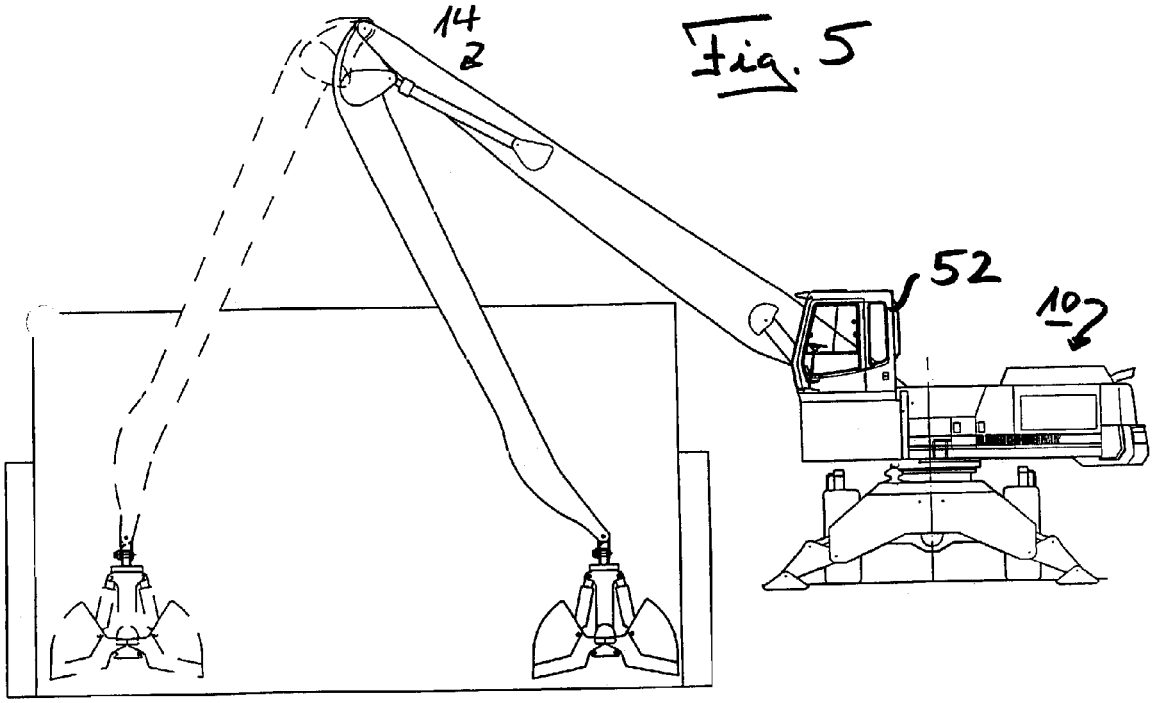
FIG. 5: A diagrammatic representation of a material transloading equipment unit in use with different positions of the boom.

FIG. 5 shows a transloading equipment unit without bearing block enhancement. To prevent collision of the arm with the wall of the ship on the one hand, and to permit unloading of the entire ship bottom on the other hand, a relatively long boom and a long shaft are necessary.

Figure 6:
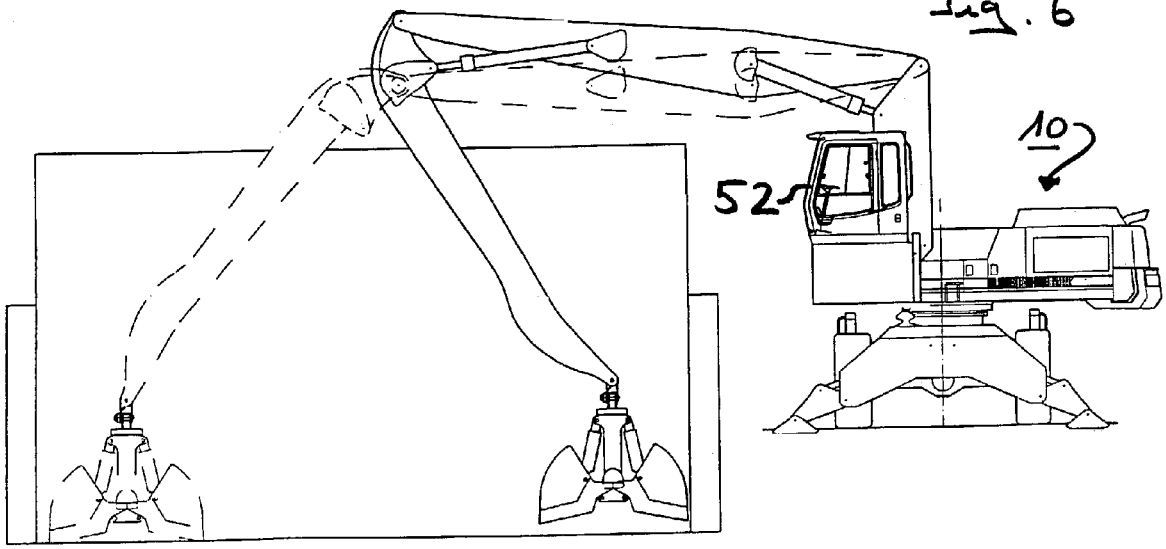
FIG. 6: A representation according to FIG. 5 of a material transloading equipment unit according to the within invention.

FIG. 6 shows a transloading equipment unit with bearing block enhancement. Compared to FIG. 5, the arm and the shaft can be shorter and therefore lighter. A collision of boom and ship can effectively be prevented here. The entire ship bottom can be reached by the transloading unit, so that the material to be unloaded can be reached at every point of the ship bottom without difficulty. The bearing block is positioned inside the rocking edge of the equipment, and thereby provides in addition for an enhanced stationary moment.

The invention claimed is:

1. A material handling appliance, comprising an undercarriage (34), a slewing ring (36) mounted upon said undercarriage (34), a turntable (12) rotatably mounted upon said undercarriage (34) via said slewing ring (36) and comprising a first pivot point (22) to which a boom (14) is pivotally hinged, at least one lifting cylinder (24) arranged to pivot said boom (14) about said first pivot point (22), said turntable (12) being provided with a second pivot point (26) to which the lifting cylinder (24) is secured, a third pivot point (28) being situated where the at least one lifting cylinder (24) is secured to the boom (14), a fourth pivot point (32) being provided on said turntable (12) to rotate therewith and arranged such that the lower end of the boom (14) can be pivotally mounted therat instead of at said first pivot point (22), and a fifth pivot point (34) arranged such that the at least one lifting cylinder (24) can be secured thereto to pivot the boom (14) instead of being secured to said third pivot point (28), said first (22), second (26) and fourth (32) pivot points defining apices of a triangle having an obtuse angle located at the apex of said fourth pivot point (32), and said first (22) and fourth (32) pivot points being arranged with respect to one another such that pivoting said boom (14) at said fourth pivot point (32) from said first pivot point (22) results in shifting maximum moment of said lifting cylinder (24) from a steeper to a flatter setting angle with respect to ground.

2. The appliance of claim 1, wherein said fifth pivot point (34) is provided on the boom (14).

3. The appliance of claim 2, wherein said turntable (12) additionally comprises at least one bearing block (38,39) in turn, comprising said first, second and fourth pivot points (22, 26, 32).

4. The appliance of claim 2, wherein said first pivot point (22) is positioned higher than said second pivot point (26) and lower than said fourth pivot point (32).

5. The appliance of claim 2, wherein said first, second and fourth pivot points (22, 26, 32) are constituted by openings in said turntable (12) such that the boom (14) can be secured to said turntable (12) via bolts.

6. The appliance of claim 5, wherein said turntable (12) additionally comprises at least one bearing block (38,39) in turn, comprising said first, second and fourth pivot points (22, 26, 32).

7. The appliance of claim 1, additionally comprising a pivot plate (30) secured to the boom (14) and provided with said third and fifth pivot points (28, 34).

8. The appliance of claim 7, wherein said first, second and fourth pivot points (22, 26, 32) are constituted by openings in said turntable (12) such that the boom (14) can be secured to said turntable (12) via bolts.

9. The appliance of claim 8, wherein said turntable (12) additionally comprises at least one bearing block (38,39) in turn, comprising said first, second and fourth pivot points (22, 26, 32).

10. The appliance of claim 7, wherein said turntable (12) additionally comprises at least one bearing block (38,39) in turn, comprising said first, second and fourth pivot points (22, 26, 32).

11. The appliance of claim 1, wherein said first, second and fourth pivot points (22, 26, 32) are constituted by openings in said turntable (12) such that the boom (14) can be secured to said turntable (12) via bolts.

12. The appliance of claim 11, wherein said turntable (12) additionally comprises at least one bearing block (38,39) in turn, comprising said first, second and fourth pivot points (22, 26, 32).

13. The appliance of claim 1, wherein said turntable (12) additionally comprises at least one bearing block (38,39) in turn, comprising said first, second and fourth pivot points (22, 26, 32).

14. The appliance of claim 1, structured and arranged to provide maximum moment with the lifting cylinder (24) with a setting angle of about 22.7 degrees for the boom (14).

15. The appliance of claim 14, wherein the cylinder (24) is situated underneath the boom (14).

16. The appliance of claim 14, wherein said first pivot point (22) is positioned higher than said second pivot point (26) and lower than said fourth pivot point (32).

17. The appliance of claim 1, wherein the boom (14) comprises two arms (16, 18), a first (16) of said boom arms (16, 18) being pivotally hinged to said turntable (12), and a second (18) of said boom arms (16, 18) being pivotally hinged to said first boom arm (16) at a sixth pivot point (20).

18. The appliance of claim 17, structured and arranged to provide maximum moment with the lifting cylinder (24) with a setting angle of about 22.7 degrees with said first boom arm (16).

19. The appliance of claim 1, wherein said turntable (12) is rotatably mounted about a substantially vertical axis and in a substantially horizontal direction.

20. The appliance of claim 19, wherein said third and fifth pivot points (28,34) are separately provided, at the same time, apart from one another at different locations.

21. The appliance of claim 20, wherein the cylinder (24) is situated underneath the boom (14).

22. The appliance of claim 19, wherein the cylinder (24) is situated underneath the boom (14).

23. The appliance of claim 19, wherein said first pivot point (22) is positioned higher than said second pivot point (26) and lower than said fourth pivot point (32).

24. The appliance of claim 1, wherein said third and fifth pivot points (28,34) are separately provided, at the same time, apart from one another at different locations.

25. The appliance of claim 24, wherein the cylinder (24) is situated underneath the boom (14).

26. The appliance of claim 25, wherein said first pivot point (22) is positioned higher than said second pivot point (26) and lower than said fourth pivot point (32).

27. The appliance of claim 1, wherein the cylinder (24) is situated underneath the boom (14).

28. The appliance of claim 1, wherein said first pivot point (22) is positioned higher than said second pivot point (26) and lower than said fourth pivot point (32).

29. The appliance of claim 28, wherein said turntable (12) additionally comprises at least one bearing block (38, 39) detachably coupled thereto to rotate therewith and, in turn, comprising said first, second and fourth pivot points (22, 26, 32).

30. The appliance of claim 1, structured and arranged to constitute transloading equipment for ships.

* * * * *